United States Patent [19]

Roberts

[11] Patent Number: 4,511,144

[45] Date of Patent: Apr. 16, 1985

[54] MULTI-CUBE PUZZLE

[76] Inventor: Patrick A. Roberts, 9348 Cherry Hill Rd., #624, College Park, Md. 20740

[21] Appl. No.: 425,539

[22] Filed: Sep. 28, 1982

[51] Int. Cl.[3] ..... A63F 9/08

[52] U.S. Cl. ..... 273/153 S

[58] Field of Search ..... 273/153 S, 157 R

[56] References Cited

U.S. PATENT DOCUMENTS

| | | | |
|---|---|---|---|
| 498,639 | 5/1893 | Fields | 273/153 S |
| 3,289,322 | 12/1966 | Patrick | 434/277 |
| 3,523,384 | 8/1970 | Adelsohn | 273/157 R |
| 3,841,638 | 10/1974 | Sinden | 273/153 S |

FOREIGN PATENT DOCUMENTS

| | | | |
|---|---|---|---|
| 2152360 | 4/1973 | Fed. Rep. of Germany | 273/153 S |
| 2064965 | 6/1981 | United Kingdom | 273/153 S |
| 2100134 | 12/1982 | United Kingdom | 273/153 S |

*Primary Examiner*—Anton O. Oechsle

*Attorney, Agent, or Firm*—Warren N. Low

[57] ABSTRACT

A multi-cube puzzle characterized by a generally cubical array of individual cubes wherein the individual cubes are arranged in a single angular layer as viewed from each face of the cube, excepting for one small cube thereby to permit unlimited one square at a time movement of any small cube adjacent the gap, thereby to reposition the cubes as required in solving a puzzle pattern.

13 Claims, 5 Drawing Figures

MULTI-CUBE PUZZLE

BACKGROUND OF THE INVENTION

In recent years diverse hand-manipulated geometric puzzles have increased in popularity and ingenuity of development with a view toward the increasing interest of individuals in the mental challenges in solving such puzzles and the manual dexterity required for the same.

Many such puzzles are known in the art and are available in the marketplace. To date, however, there has not been available an easily handled puzzle requiring only modest dexterity while presenting a difficult challenge in effecting a desired reorientation of color or pattern of individual small cubes arranged in a cubical array.

Existing cube-type games include that known as "Rubik's Cube" which while challenging is inordinately complex both in concept and physical manufacture. On the other end of the scale with respect to shifting piece puzzles, the well-known planar array of 15 slidable squares in a 4×4 pattern provides a challenge that is far more readily solved than when effecting solution of a position problem in a three dimensional environment.

Other sliding block puzzle games are exemplified by the U.S. Pat. Nos. to Sinden 3,841,638 and Kosareck 3,845,959.

BRIEF DESCRIPTION OF THE INVENTION

The present invention provides a unique, challenging, and yet solvable three-dimensional puzzle uniquely characterized by a cubical array of individual smaller cubes wherein complexity is minimized in that the permitted single cube length movement is confined to a path only along one of the 12 side edges of the cube. To this end, and permitting simple and economical manufacture, the puzzle includes a core element of six-pointed star-like configuration upon the exterior surfaces of which other than the distal ends the smaller individual cubes are supported, guided, and permitted to be moved.

To this end, and as seen viewing any primary face of the cubical puzzle, there is defined a square annular array of cubes along each edge of the large cube, and which square annular pattern of cubes bounds the central core.

Thus, in an illustrative embodiment, a single side of the cube presents a 3×3 pattern, that is with three cubes or spaces for three cubes along each edge of the single square face, thereby to define a square annular array with a central open area. The supporting core extends into this central area on each face of the cube, and the core is provided with retaining means at the distal core ends thereby to retain the cubes in position.

Accordingly, in such a 3×3 cube, it will be seen that there are a total of 20 cube spaces which are occupied as indicated by 19 such smaller cubes, the vacant or void cube space being provided to permit requisite shifting movement of the cubes on a one-by-one basis.

Accordingly, with any given desired pattern provided on the cubes or upon the exterior visible faces thereof, it will be seen that movement of the cubes one at a time and in any random or predetermined order will effect a rearrangement of the pattern presented on any or all exterior faces, as, for example, a complete inversion of a color pattern from one to another.

In a preferred embodiment of the invention, each smaller cube is provided with three touching faces of one color and the remaining three mutually touching faces of another color.

With the exemplary arrangement, it will be seen that the cubical pattern can be so arranged that only one color is visible on one face along all side edges of the large cubical array, but by appropriate repositioning of the individual cubes one at a time, the array can be fully converted into a pattern of the opposite color.

BRIEF DESCRIPTION OF THE DRAWINGS

The invention will be better understood when taken in connection with the accompanying drawings in which.

DESCRIPTION OF THE PREFERRED EMBODIMENT

Figure 1:
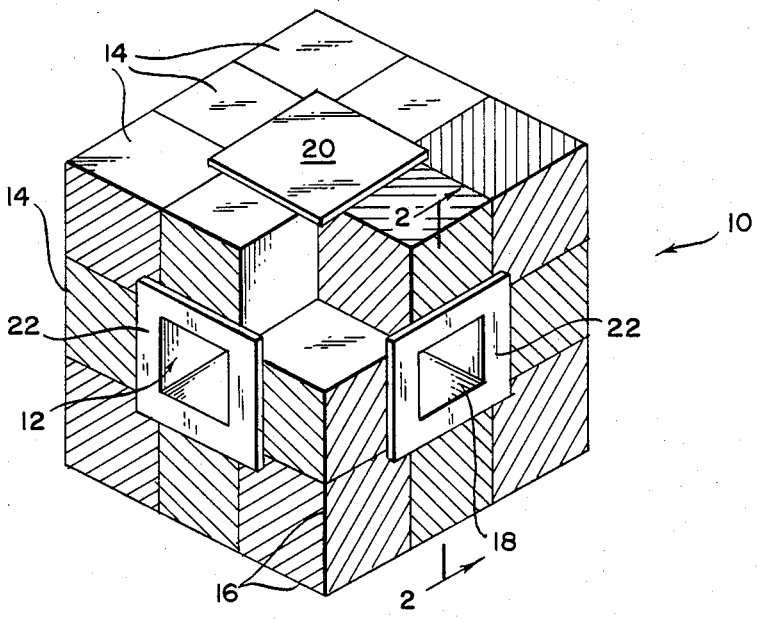
FIG. 1 is a perspective view of the puzzle according to the invention with an illustrative color pattern thereon.
Figure 2:
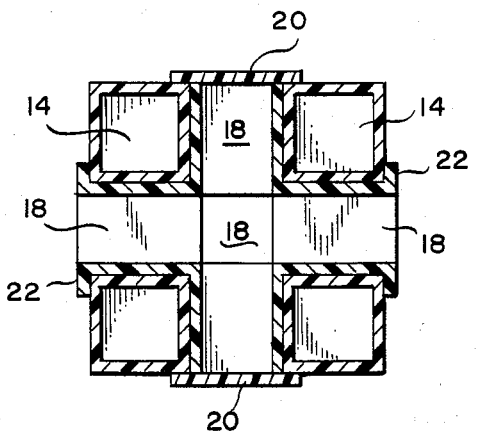
FIG. 2 is a side sectional view taken on the line 2—2 of FIG. 1.

The multiple cube puzzle of the present invention is illustrated generally at 10 in FIG. 1 and essentially includes a central star-like core 12 best seen in FIG. 2 and so configured as to receive upon and adjacent the surfaces thereof a number of smaller individual cubes 14. The cubes 14 are so arrayed that all smaller cubes 14 are supported on and adjacent core 12 to form a single large cube assembly as at 10 wherein each of the smaller cubes 14 is disposed along and assists in forming one or two of the twelve corner edges 16 of the larger cube.

There are a sufficient number of smaller cubes 14 so as to entirely form the larger cube, less a single smaller cube 14 as clearly seen in FIG. 1 wherein the uppermost proximate cube is absent to form a "void cube" space.

In the illustrated form of the invention, the twelve corner edges 16 of the large cube are defined by a total of nineteen smaller cubes 14, twenty cubes being required to fully complete the large cube as shown were the void space filled.

Stated otherwise, the small cube and core arrangement is such that on any given face of the large cube, the small cubes (or the small cubes and the void cube) define a square annulus about a portion of the central core 12. In the form illustrated in FIG. 1, eight such cubes 14 are required to define each complete square annulus on any face of the main cube. In the embodiment shown, there are seven cubes on each such face, the cornermost cube as noted on the upper layer being absent to define the void cube.

Means are provided to retain the individual cubes 14 in assembled relation for ease of manipulation. The same include end retaining members or caps as at 20, 22 disposed at the the distal end of each leg 18 of the core 12. As in evident, each retaining member possesses a flange-like exterior periphery slightly larger than a single face of a smaller cube 14, thereby to overlie in part all cubes along its face of the primary cube. It will be evident that with the slight overlap shown, it is not possible for any individual cube 14 to drop or fall from the assembled relation of the main cube 10. Nonetheless, each of the smaller cubes 14 is free to slide laterally or vertically into the single hole or void cube space provided in the cubical array.

Figure 3:
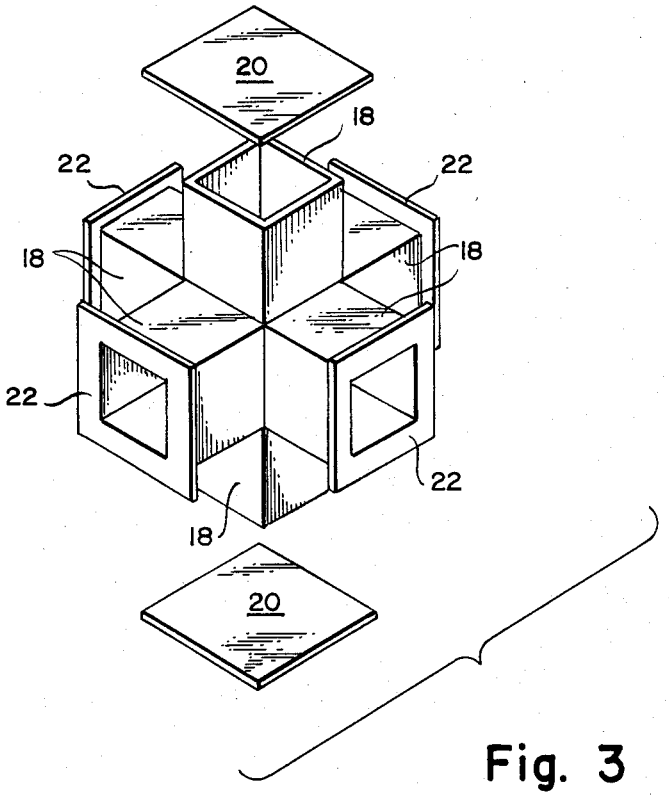
FIG. 3 is a perspective view partially exploded of the core member and the retaining members thereof.

In one form of the invention, the retaining members 22 are formed as integral one piece elements with the associated leg 18. Thus, for simplicity, the central core portion as seen in FIG. 3 may be readily molded from plastic in essentially tubular form and wherein the four legs 18 lying in one horizontal plane will each have formed thereon a laterally outwardly directed flange thereby providing the retaining member as at 22. For simplicity, the vertically extending legs 18 have no such flanges thereon, but rather are provided with separate end retainer caps 20 which may be adhesively bonded or fused to the distal ends of legs 18 after assembly of the small cubes 14 with the core.

It will be evident from FIG. 3 that all nineteen small cubes 14 may be physically positioned about the core and thereafter the upper and lower retainers 20 secured thereto. The lower cap 20 might initially be applied before the cubes, as the smaller cubes 14 could be dropped vertically with respect to FIG. 3 downwardly onto the edge of the lower cap 20 and then passed laterally beneath an adjacent leg 18, but for more ready assembly, both caps 20 are preferably attached subsequent to grouping of the small cubes 14 around the core 12.

Alternatively, a separate cap like member 20 could be employed at the end of each of the legs 18 in the absence of integral formations thereon as at 22.

In the preferred embodiment, the core 12 may be readily and inexpensively formed from molded plastic, although it is evident that the same may comprise any other material which provides a requisite support for the individual cubes 14 and their lateral and vertical movement. Thus, the core could be formed simply from a plurality of wooden blocks or pieces, or from metal.

In like manner, the cubes 14 themselves may be readily fabricated as desired. In the simplest form, the cubes 14 may be formed from small wooden blocks and thereafter suitably decorated or marked with indicia as desired.

Figure 4:
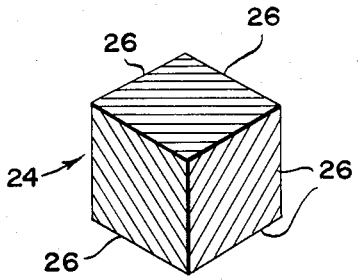
FIG. 4 is a perspective view of the exterior faces one half of a smaller cube prior to assembly having one color thereon.
Figure 5:
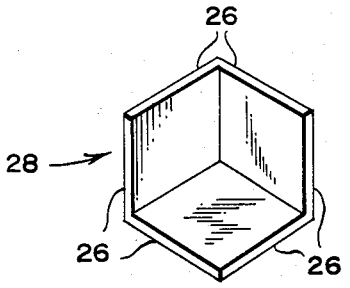
FIG. 5 is a perspective view of the interior faces of one half of a cube prior to assembly with that half in FIG. 4, and having another color thereon.

In the preferred form of the invention, and representing both a saving of weight and material, the individual cubes 14 are formed from two mirror image three-sided or faced elements as seen in FIGS. 4 and 5. Thus, in FIG. 4, the one-piece molded three sided element 24 includes six exposed peripheral edges 26, while the opposite half cube element 28 in FIG. 5 is likewise obviously provided with the same edges 26. The two half-cube elements 24, 28 are thus butted together along the edges 26 and suitably joined as by adhesive or fusion techniques to form the complete single cube 14.

As is evident from the foregoing structure, any given cube 14 may be transposed to any position whatever along any exterior angle edge of the primary or main large cube array 10 by the step-by-step transpositioning thereof in horizontal or vertical planes utilizing the void cube space.

With this in mind then, the instant construction is particularly well adapted to a puzzle of diverse and challenging form as determined by the indicia or marking selected for the individual cubes 14.

Thus, the upper right-hand most cube 14 in FIG. 1, for example, may be readily translated along the main cube edges 16 about the entire face periphery of the large cube within the right-hand retaining cap 20, for example, by the simple expedient of shifting the cubes successively to the left toward the void cute and filling the newly created void cube space from the right in a counterclockwise square motion of the cubes on that face. In like manner, any cube 14 may travel horizontally along the top and bottom faces.

In one working embodiment of the invention as a challenging puzzle, three adjacent faces of the six faces on a small cube 14 are of one color, as illustratively shown in FIG. 4, while the remaining three faces of the cube 14 are another color, as illustratively indicated by the non-shading in FIG. 5, prior to joining along lines 26. See FIG. 1, for example wherein the most proximate cube beneath the void cube has two shaded faces visible between the end caps 20, while the upper face thereof is of different color character.

It will be seen then that with a suitable positioning of the cubes 14 in assembling the puzzle 10, one or more entire faces of the main cube in the annular exposed area thereof may be of one color, and by appropriate sliding in horizontal and vertical directions, the several cubes 14 may be repositioned so as to convert that colored face into a face of a different color or pattern of colors.

The variety of positionings is therefore virtually unlimited. While in one actual operative and preferred embodiment, each cube has the two respective colorations thereof on respective three-face halves, differing patterns may be employed of geometric nature, stripes, outlines of figures, etc. Upon appropriate sliding and shifting of the individual cubes 14 along the edge peripheries 16 of the primary cube, a desired pattern may be achieved or destroyed.

It will therefore be seen that an endless variety of puzzles and challenges are provided by the cubical array of the present invention, yet with minimum fabrication and assembly complexities and costs.

In a further form of the invention, one or more of the end caps 20 may be snap-fitted or otherwise detachably secured to the core element thereby to permit ready removal thereof for selective repositioning of the cubes 14 in accordance with a predetermined scheme, printed selected game instructions, or the like. A cap 20 may be readily assembled in a snap fit by the provision thereon, for example, of a depending skirt sized to fit internally of a core leg 18 and having an outer peripheral bead on its surface dimensioned to mate with a corresponding peripheral recess on the interior of the associated leg 18. In this manner, the cubes 14 are retained for any given puzzle manipulation, but can readily be removed and repositioned by temporary removal of a snap-cap 20.

What I claim is:

1. A multi-cube puzzle comprising an array of individual smaller cubes defining together a cubical array forming a substantially larger cube the exposed faces of which larger cube have an edge length equivalent to a multiple of that of said individual cubes, each said face of said cubical array being defined by an annular series of cubes in square form excepting a single void cube zone in said array together defining the edges of the cubical array, and thereby to define six square annuli on said cubical array each having a square central open area, the open areas centrally of said cubical array defining three transverse intersecting passages through said array having a six-pointed rectilinear star-like form, said open areas having therein a six-legged central core upon which and against which said individual cubes are retained and partake of sliding movement, thereby to permit translation of any one cube from any position in said cubical array to any other position therein by digital manipulation and movement thereof along an exposed face through said single void cube zone, and, separate end retainer means carried by each leg of said core and engaging a portion of an exposed face of each said smaller cube thereby to retain said individual cubes in grouped array for sliding movement while permitting free digital access to each face annulus.

2. The puzzle of claim 1 wherein said central core is formed from molded plastic.

3. The puzzle of claim 2 wherein said cubes are formed from plastic material.

4. The puzzle of claim 3 wherein said cubes are hollow.

5. The puzzle of claim 4 wherein said individual cubes are formed from two like halves, each half consisting of three adjacent contiguous faces, and with the said halves joined to each other along their respective non-contiguous faces.

6. The structure of claim 1 wherein said cubes are formed from blocks of wood.

7. The structure of claim 1 wherein said cubes partake of a predetermined pattern.

8. The puzzle of claim 7 wherein each said cube is provided with a differing appearance on three adjacent faces thereof.

9. The puzzle of claim 8 wherein three of said faces are of one color and the remaining three of said faces are another color.

10. The puzzle of claim 8 wherein a total of nineteen cubes and a single void cube zone are disposed about said core, thereby to define a $3\times3$ cube array on each face of the larger cube.

11. The puzzle of claim 1 wherein said retainer means are integrally formed with said core.

12. The puzzle of claim 1 wherein said retainer means includes a detachably secured retainer means.

13. The puzzle of claim 1 wherein a total of nineteen cubes and a single void cube zone are disposed about said core, thereby to define a $3\times3$ cube array on each face of the larger cube.

* * * * *